US005833084A

United States Patent [19]

Chang

[11] Patent Number: 5,833,084

[45] Date of Patent: Nov. 10, 1998

[54] MODULAR RACK

[76] Inventor: Hsi-Te Chang, No. 76, Chien-Hsing Rd., Ke-Tso Tsun, Yuan-Chang Hsiang, Yun-Lin Hsien, Taiwan

[21] Appl. No.: 896,863

[22] Filed: Jul. 18, 1997

[51] Int. Cl.[6] ..... A47F 5/00

[52] U.S. Cl. ..... 211/187; 108/107; 211/181.1; 211/90.03

[58] Field of Search ..... 211/187, 182, 211/181.1, 90.03, 90.04; 108/107, 180

[56] References Cited

U.S. PATENT DOCUMENTS

| | | | |
|---|---|---|---|
| 2,970,702 | 2/1961 | Maslow | 211/181.1 X |
| 3,225,720 | 12/1965 | Maslow | 211/181.1 X |
| 3,316,864 | 5/1967 | Maslow | 211/181.1 X |
| 3,343,506 | 9/1967 | Buchbinder et al. | 108/107 |
| 4,778,066 | 10/1988 | Stiernberg | 211/181.1 X |
| 5,027,959 | 7/1991 | Luukkonen | 211/187 X |
| 5,065,873 | 11/1991 | Tseng | 211/187 |
| 5,221,014 | 6/1993 | Welch et al. | 211/187 |
| 5,542,530 | 8/1996 | Freelander | 211/187 X |

*Primary Examiner*—Robert W. Gibson, Jr.

*Attorney, Agent, or Firm*—Christie, Parker & Hale, LLP

[57] ABSTRACT

A modular rack includes a pair of lateral frame portions with opposing inner surfaces, a shelf plate and four corner pieces. Each of the lateral frame portions includes two upright post units, each of which includes two upright pillars that cooperatively define a slot therebetween. Each of the lateral frame portions further includes a horizontal linking rod which interconnects the post units and which has an inner surface at the same side as the inner surface of the corresponding one of the lateral frame portions. Each of the corner pieces has a bottom wall, a top wall, and first and second side walls which interconnect the top and bottom walls. The first side wall extends in a direction transverse to the linking rod. The top and bottom walls and the first and second side walls cooperatively define a corner space thereamong for receiving a corner of the shelf plate therein. Each of the corner pieces further has an engaging protrusion which projects from the first side wall in a direction parallel to the linking rod so as to lie longitudinally on the linking rod while protruding into the slot. The second side wall is situated outwardly of the plane of the inner surface of the linking rod of the corresponding one of the lateral frame portions, thus resting the bottom wall on the linking rod.

5 Claims, 8 Drawing Sheets

MODULAR RACK

BACKGROUND OF THE INVENTION

1. Field of the Invention

The present invention relates to a modular rack, more particularly to a modular rack having a corner piece which is not easily damaged during transport, which imparts enhanced stability to the modular rack, and which facilitates assembly of the modular rack.

2. Description of the Related Art

Referring to FIG. 1, a conventional modular rack 1 is shown to include a pair of lateral frame portions 11 and two shelf plates 12 disposed transversely between the lateral frame portions 11. Each of the lateral frame portions 11 includes a parallel pair of post units 111 and a plurality of horizontal linking rods 114 extending transversely between the post units 111. A pair of crossed connecting bars 112 are provided between two rear ones of the post units 111 for interconnecting the lateral frame portions 11. Each of the post units 111 includes a parallel pair of upright pillars 113 which have substantially rounded cross-sections and which are spaced apart from each other to define a vertical slot 115 therebetween. Each of the horizontal linking rods 114 has two opposite end portions which extend into the slots 115 of the post units 111 and which are connected securely to the pillars 113. Each of the shelf plates 12 is substantially rectangular in shape and has four corners 121. Each of the shelf plates 12 is mounted on the pair of lateral frame portions 11 by means of a pair of connecting units 2.

Referring to FIG. 2, each of the connecting units 2 includes two corner pieces 21 and an elongated plate 22 for interconnecting the corner pieces 21. Each of the corner pieces 21 is formed from a bent metal plate 210, and has a top wall 213, a bottom wall 214, a curved first side wall 212 and an upright second side wall 217 which interconnect the top and bottom walls 213, 214, and a hook protrusion 215 extending outwardly of the second side wall 217. The first side wall 212, the top wall 213 and the bottom wall 214 cooperatively form a U-shaped figure and cooperatively confine a corner space 220 with the second side wall 217. The hook protrusion 215 has a curvature conforming to a periphery of a respectively one of the pillars 113. Since the corner piece 21 is formed from the bent metal plate 210, a slit 218 is formed on the second side wall 217. The second side wall 217 is further formed with two fastening holes 219 at the slit 218. The elongated plate 22 has two end portions extending into the corner spaces 220 of the corner pieces 21. Each of the end portions of the elongated plates 22 is formed with two fastening holes 221 aligned with the fastening holes 219 of the second side wall 217 of a respective one of the corner pieces 21 to permit extensions of fasteners, such as screws 23, therethrough. The end portions of the elongated plate 22 are welded to the second side walls 217 of the corner pieces 21 to prevent distortion of the corner piece 21 due to the presence of the slits 218 at the second side walls 217.

Referring to FIGS. 1 and 2, to assemble the modular rack 1, the connecting units 2 are mounted on two lateral edge portions of the shelf plate 12 in such a manner that the corners 121 of the shelf plate 12 are received in the corner spaces 220 of the corner pieces 21. The screws 23 are extended threadedly through the aligned fastening holes 219, 221 and into the shelf plate 12 so as to mount the connecting units 2 on the shelf plate 12. The shelf plate 12, together with the connecting units 2 on the lateral edge portions thereof, are disposed between the lateral frame portions 11 so that the hook protrusions 215 of the corner pieces 21 extend into the slots 115 of the post units 111 for hooking at the respective pillar 113 and for resting on the respective elongated rod 114 (see FIG. 3). Assembly of the modular rack 1 is thus completed. If necessary, additional shelf plates 12 can be mounted likewise as desired.

Some of the drawbacks of the conventional modular rack 1 are as follows:

1. Since the curved hook protrusion 215 of the corner piece 21 extends outwardly of the second side wall 217, it is frequently damaged or twisted during transport of the various components of the modular rack 1. The damaged or twisted hook protrusion 215 of the corner piece 21 can hardly conform with the periphery of the respective pillar 113. This causes difficulty in the assembly of the modular rack 1.
2. Referring to FIG. 3, after assembly of the modular rack 1, only the hook protrusions 215 of the corner pieces 21 rest on the linking rods 114. As such, the combined weight of the remaining part of the corner pieces 21, the elongated plates 22, the shelf plate 12 and objects on the shelf plate 12 are applied on the linking rods 114 via the hook protrusions 215 of the corner pieces 21. The stability of the modular rack 1 might be insufficient when a relatively heavy object is placed thereon.
3. In the modular rack 1, two adjacent ones of the corner pieces 21 must be previously connected by the elongated plate 22 which is subsequently attached to one of the lateral edge portions of the shelf plate 12. As such, the connecting unit 2 can only be used with a shelf plate 12 that has a width equal to the length of the elongated plate 22. Moreover, since the curvature of the hook protrusion 215 of each of the corner pieces 21 is designed to conform with the periphery of the respective one of the pillars 113 for hooking thereat, the size of the cross-section of the pillars 113 that can be used is also limited.

SUMMARY OF THE INVENTION

The main object of the present invention is to provide a modular rack which is more stable, which is not easily damaged during transport, and which includes corner pieces that can be used with shelf plates of different sizes.

Accordingly, the modular rack of the present invention includes a pair of lateral frame portions, a shelf plate and four corner pieces. The lateral frame portions have opposing inner surfaces. Each of the lateral frame portions includes two upright post units, each of which includes two upright pillars that cooperatively define a slot therebetween. Each of the lateral frame portions further includes a horizontal linking rod which has two opposite ends that extend into the slots of the post units for connection with the post units and which has an inner surface at the same side as the inner surface of the respective one of the lateral frame portions. The shelf plate is disposed transversely between the lateral frame portions, and has four corners to be mounted to the post units. The corner pieces are used for receiving and mounting the corners of the shelf plate on the lateral frame portions. Each of the corner pieces has a bottom wall for resting on the linking rod of a corresponding one of the lateral frame portions, a top wall, and first and second side walls which interconnect the top and bottom walls. The first side wall extends in a direction transverse to the linking rod of the corresponding one of the lateral frame portions. The top and bottom walls and the first and second side walls cooperatively define a corner space thereamong. Each of the corner pieces further has an engaging protrusion which projects from the first side wall in a direction parallel to the linking rod so as to lie longitudinally on the linking rod of the corresponding one of the lateral frame portions while protruding into the slot of an adjacent one of the post units for positioning the corner piece. The second side wall is situated outwardly of the plane of the inner surface of the linking rod of the corresponding one of the lateral frame portions, thus resting the bottom wall on the linking rod.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
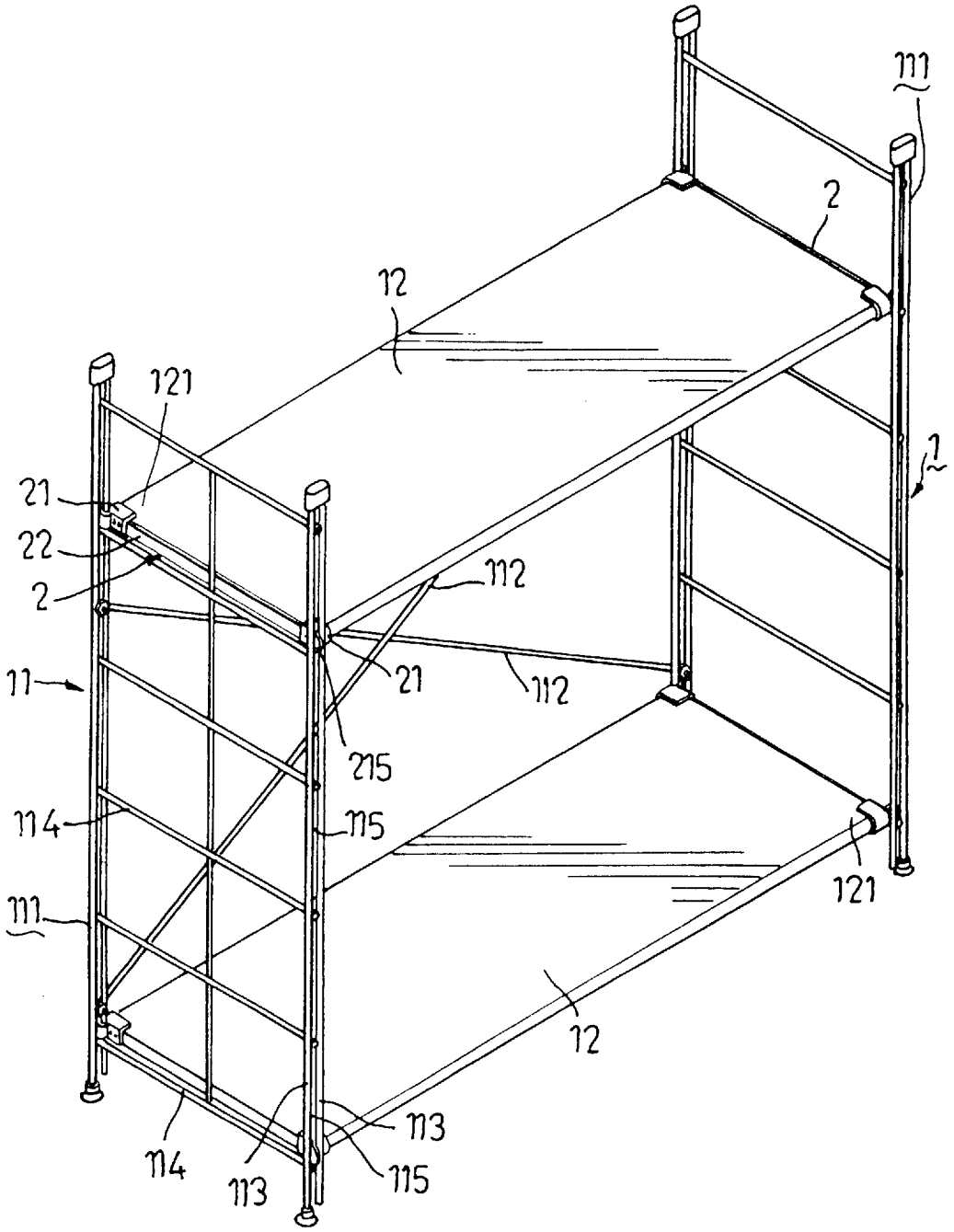
FIG.1 PRIOR ART
FIG. 1 is a perspective view illustrating a conventional modular rack.
Figure 2:
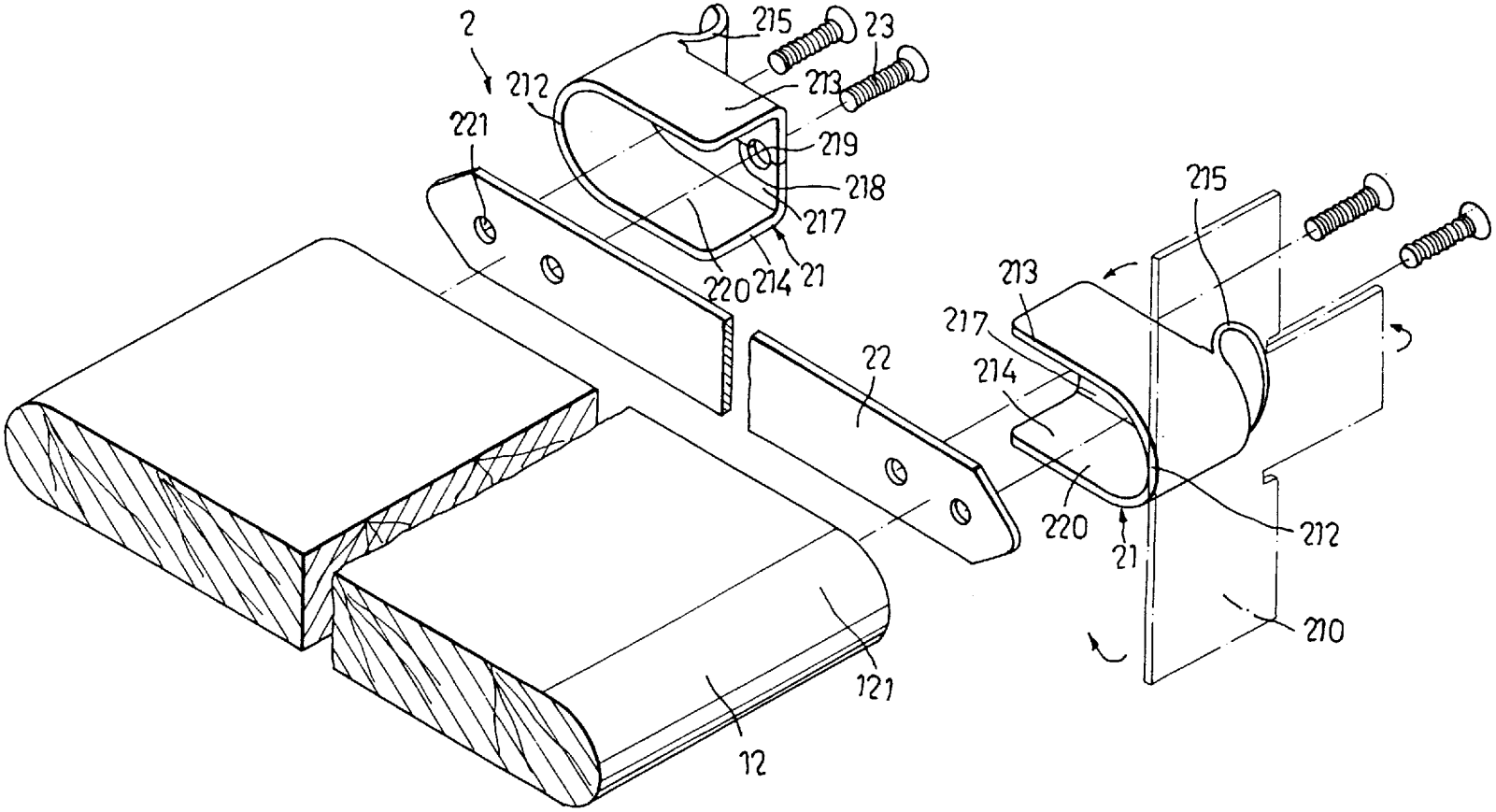
FIG. 2 PRIOR ART
FIG. 2 is a partly exploded perspective view illustrating a connecting unit of the conventional modular rack.
Figure 3:
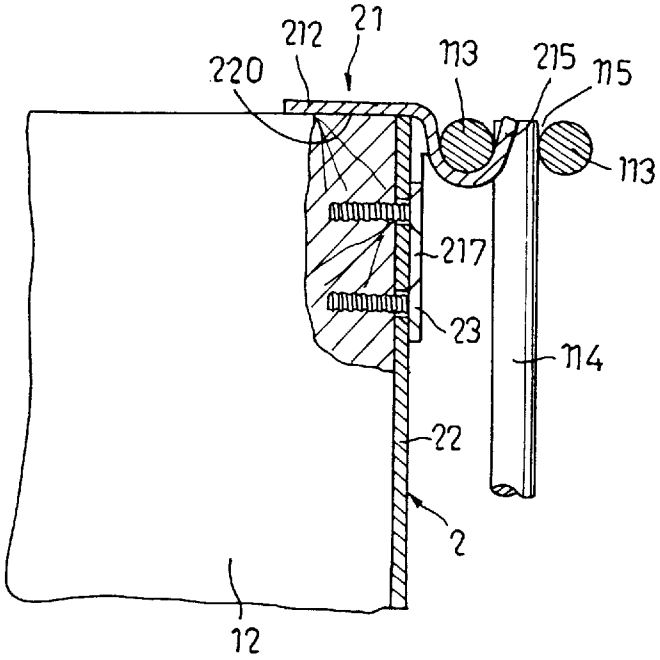
FIG. 3 PRIOR ART
FIG. 3 is partly cross-sectional view of the conventional modular rack.
Figure 4:
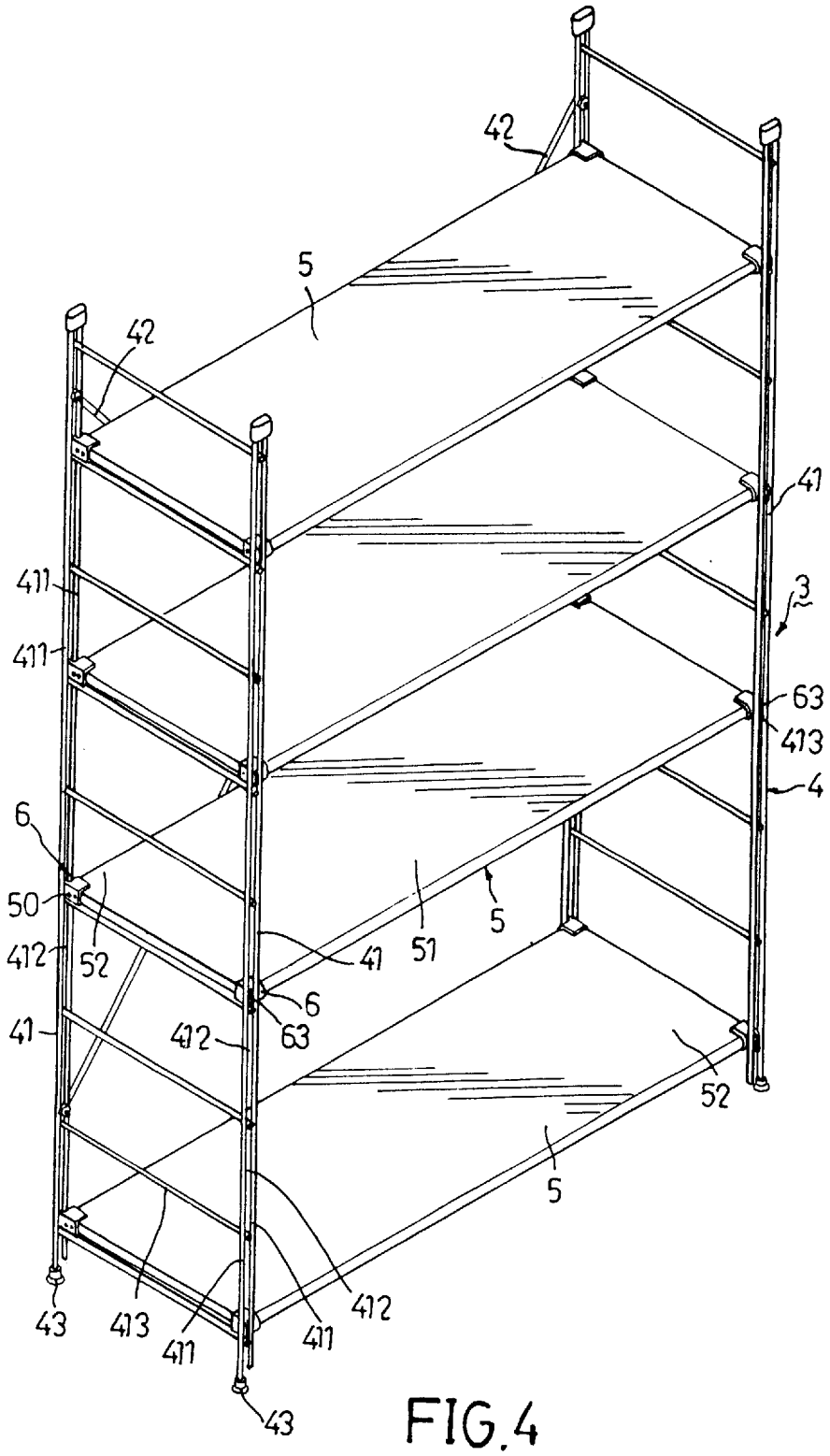
FIG. 4 is a perspective view of a modular rack according to a first preferred embodiment of the present invention.

Referring to FIG. 4, the modular rack 3 according to the first preferred embodiment of this invention is shown to include a pair of lateral frame portions 4, four shelf plates 5 and a plurality of corner pieces 6.

The lateral frame portions 4 have opposing inner surfaces. Each of the lateral frame portions 4 has two upright post units 41 which include a front one and a rear one. The rear ones of the post units 41 of the lateral frame portions 4 are connected to each other by means of two crossed connecting bars 42. Each of the post units 41 includes two upright pillars 411 which have circular cross-sections and which cooperatively define a vertical slot 412 therebetween. A foot member 43 is provided on a bottom end of one of the pillars 411 of each of the post units 41 so that the post units 41 are capable of standing on a ground surface in a stable manner. Each of the lateral frame portions 4 further includes a plurality of horizontal linking rods 413. Each of the linking rods 413 has two opposite ends which extend into the slots 412 of the post units 41 for connection with the post units 41, and has an inner surface at the same side as the inner surface of the respective one of the lateral frame portions 4.

Figure 6:
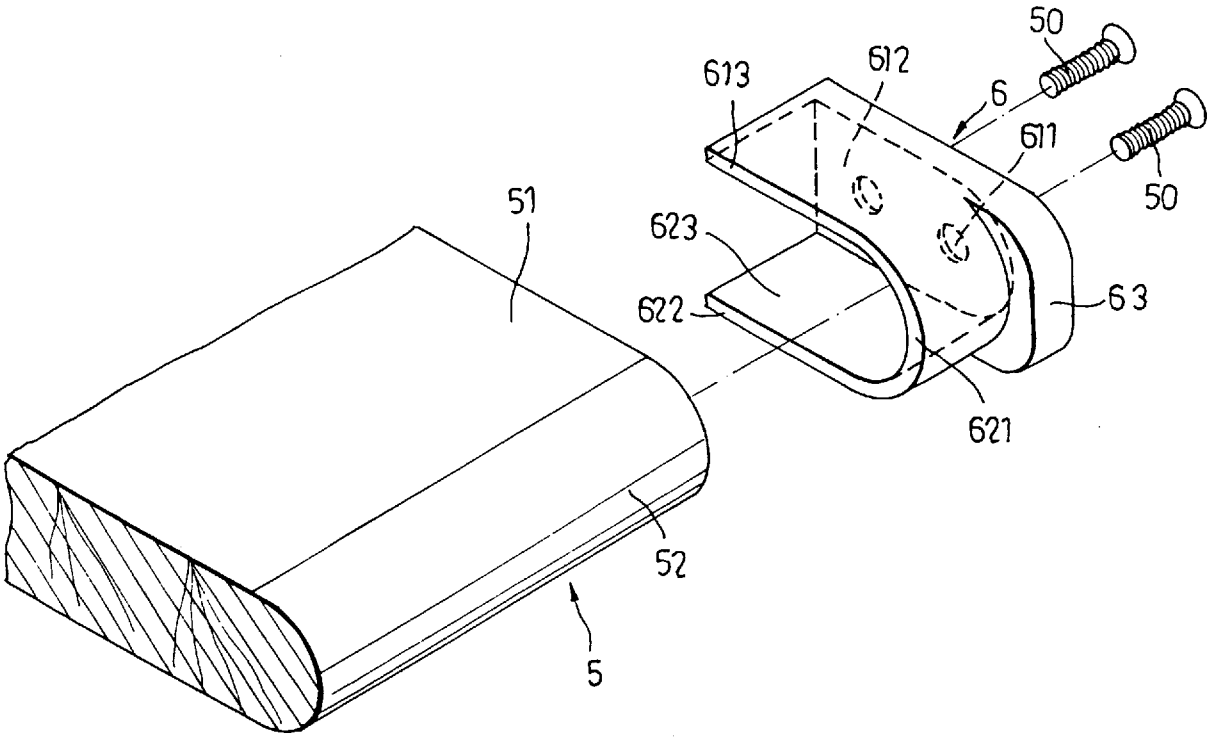
FIG. 6 is a partly exploded perspective view illustrating a corner piece of the modular rack of the present invention.

Referring to FIGS. 4 and 6, each of the shelf plates 5, which are made of wood in this embodiment, is disposed transversely between the lateral frame portions 4, and has a flat top surface 51 for placing objects thereon and four corners 52 to be mounted to the post units 41. Each of the shelf plates 5 has four of the corner pieces 6 mounted respectively on the four corners 52 thereof.

Figure 7:
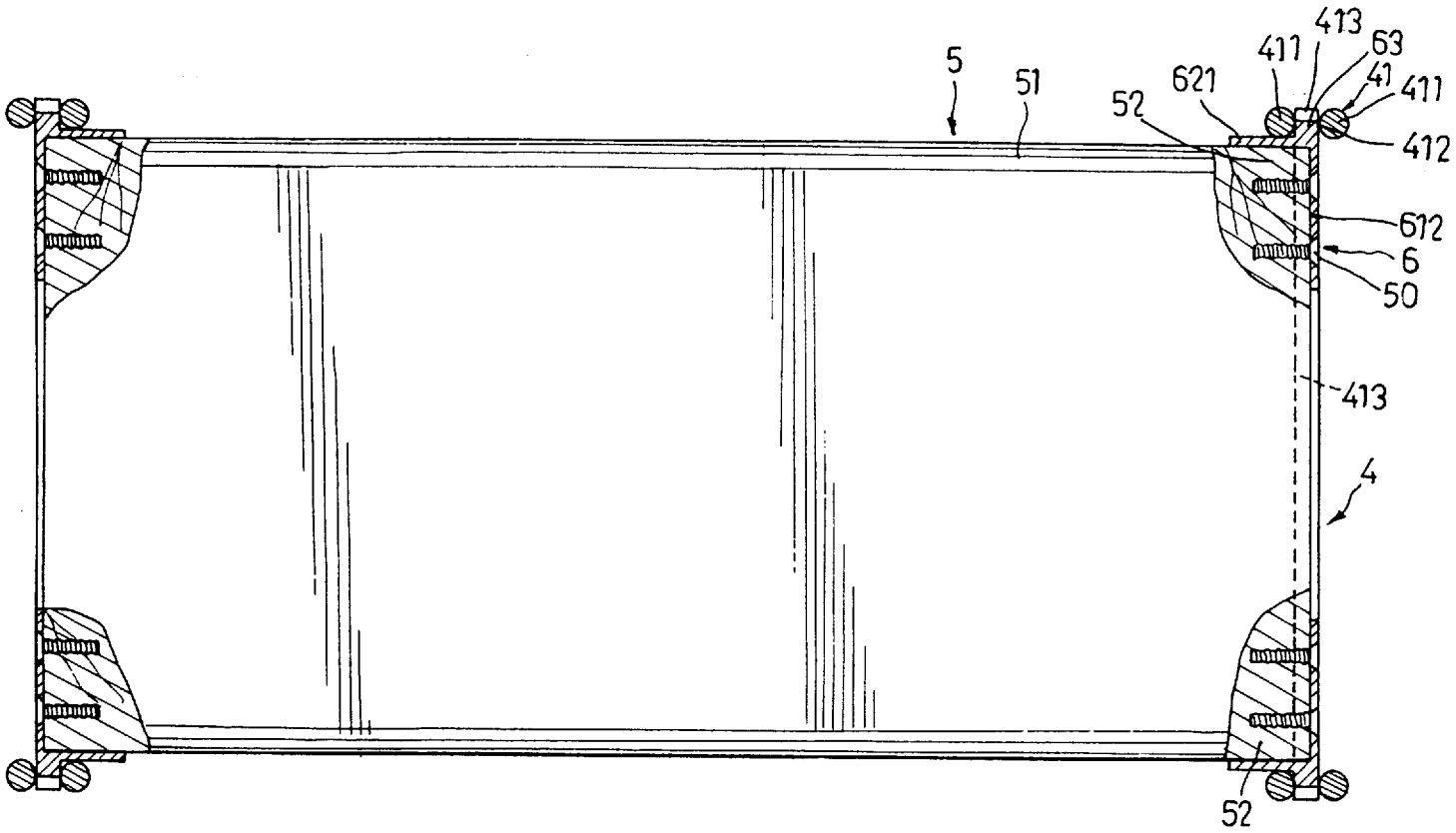
FIG. 7 is a cross-sectional view of the modular rack of FIG. 4.

Referring to FIGS. 6 and 7, each of the corner pieces 6 is formed integrally from extruded aluminum, and has a bottom wall 622 for resting on a corresponding one of the linking rods 413 of a respective one of the lateral frame portions 4, a top wall 613, and first and second side walls 621, 612 which interconnect the top and bottom walls 613, 622. The first side wall 621 extends in a direction transverse to the corresponding one of the linking rods 413 of the corresponding one of the lateral frame portions 4. The top and bottom walls 613, 622 and the first and second side walls 621, 612 cooperatively define a corner space 623 thereamong for receiving a corresponding one of the corners 52 of a corresponding one of the shelf plates 5. Each of the corner pieces 6 further has an engaging protrusion 63 which extends from the second side wall 612 and which is coplanar with the second side wall 612. As shown in FIG. 7, the engaging protrusion 63 projects from the first side wall 621 in a direction parallel to the linking rods 413 so as to lie longitudinally on a corresponding one of the linking rods 413 of a corresponding one of the lateral frame portions 4 while protruding into the slot 412 of an adjacent one of the post units 41 for positioning the corner piece 6. The engaging protrusion 63 is thicker than the second side wall 612, which is situated outwardly of the plane of the inner surfaces of the linking rods 413 of the corresponding one of the lateral frame portions 4, thus resting the bottom wall 622 on the corresponding one of the linking rods 413. The second side wall 612 is formed with two fastener holes 611 to permit extensions of two fasteners, such as screws 50, therethrough for fastening the corner piece 6 to a corresponding one of the shelf plates 5.

Figure 5:
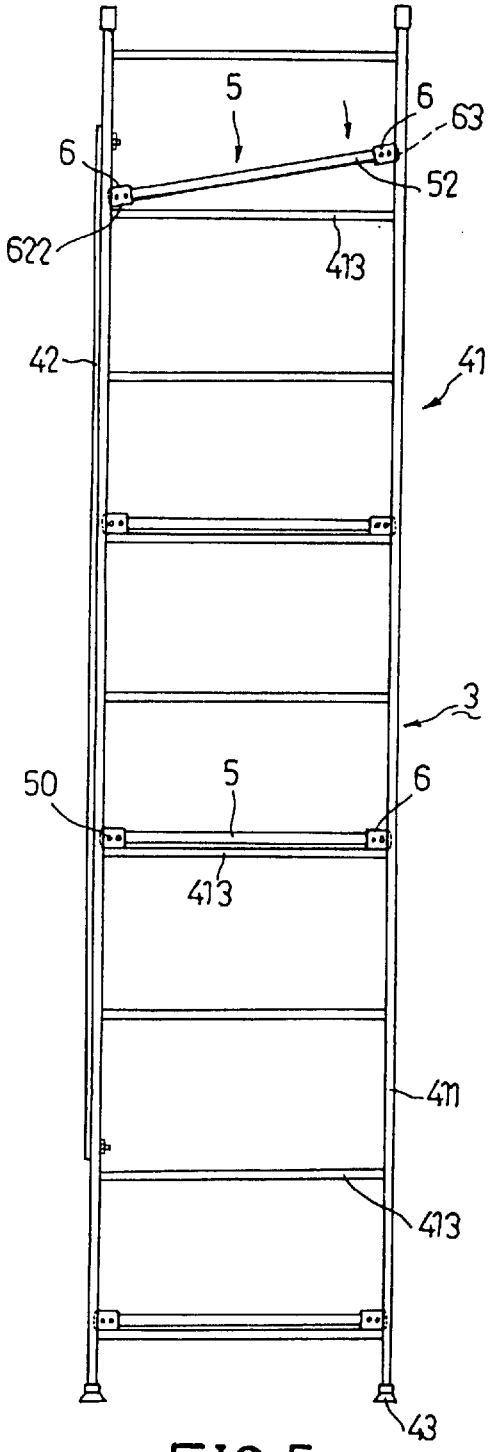
FIG. 5 is a side view of the modular rack of FIG. 4 illustrating its assembly.

Referring to FIGS. 4 and 5, to assemble the modular rack 3, the crossed connecting bars 42 are mounted between the pair of lateral frame portions 4, and the foot members 43 are sleeved on the bottom ends of selected ones of the pillars 411 of the post units 41 to erect the lateral frame portions 4. The corner pieces 6 are respectively mounted on the corners 52 of the shelf plates 5 by means of the screws 50. Thereafter, each of the shelf plates 5 with the corner pieces 6 mounted thereon is brought between the lateral frame portions 4, as shown in FIG. 5, until the engaging protrusions 63 of the corner pieces 6 extend into the slots 412 of the post units 41, and the bottom walls 622 of the corner pieces 6 rest on the corresponding linking rods 413.

Referring to FIGS. 4 and 7, after assembly, the engaging protrusion 63, the first and second side walls 621, 612 and the bottom wall 622 of each of the integrally formed corner pieces 6 rest on the corresponding linking rod 413 so as to cooperatively support the combined weight of the shelf plate 5 and the objects to be placed thereon. Moreover, since the second side wall 612 of each of the corner pieces 6 is situated outwardly of the inner surface of the corresponding linking rod 413, the two lateral edge portions of the shelf plates 5 also rest on the corresponding linking rods 413 indirectly. The shelf plates 5 can thus be supported in more stable manner on the corresponding linking rods 413.

Figure 8:
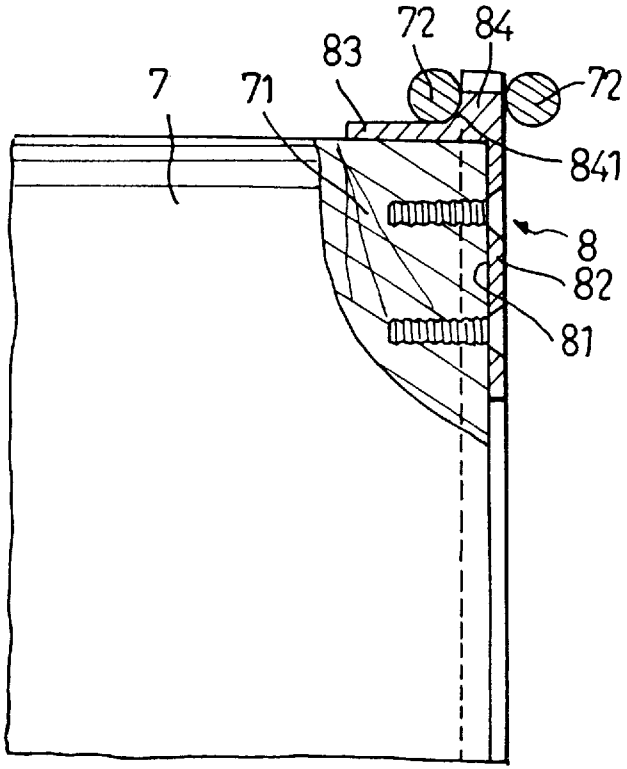
FIG. 8 is a partly cross-sectional view of a modular rack according to a second preferred embodiment of the present invention.

Referring to FIG. 8, in a second preferred embodiment, a corner piece 8 also includes top and bottom walls, first and second side walls 83, 82 which cooperatively confine a corner space 81 for receiving a corresponding one of the corners 71 of a respective one of the shelf plates 7, and an engaging protrusion 84. The engaging protrusion 84 of the corner piece 8 forms a rounded corner 841 with the first side wall 83 to embrace a corresponding one of the pillars 72, which has a circular cross-section. As such, the engaging protrusion 84 of the corner piece 8 engages the corresponding one of the pillars 72 more securely.

Accordingly, the modular rack of the present invention has the following advantages:

1. The engaging protrusions 63, 84 of corner pieces 6, 8 are not easily damaged during transport since the engaging protrusions 63, 84 do not extend outwardly from the second side wall 612, 82, but instead, are coplanar with the second side wall 612, 82.
2. The shelf plates 5, 7 can be supported in a more stable manner on the linking rods 413 with the use of the corner pieces 6, 8 which have the first and second side walls 621, 83, 612, 82, the bottom walls 622 and the engaging protrusions 63, 84 thereof resting on the corresponding linking rod 413. Moreover, the lateral edge portions of the shelf plates 5, 7 are disposed above the corresponding linking rod 413 rather than being suspended between the lateral frame portions 4.
3. Since an elongated plate for connecting the corner pieces 6, 8 can be omitted in the present invention, the corner pieces 6, 8 can be used with shelf plates 5, 7 of various sizes.

With this invention thus explained, it is apparent that numerous modifications and variations can be made without departing from the scope and spirit of this invention. It is therefore intended that this invention be limited only as indicated in the appended claims.

I claim:

1. A modular rack comprising:

a pair of lateral frame portions having opposing inner surfaces, each of which includes two upright post units, each of said post units including two upright pillars which cooperatively define a slot therebetween, each of said lateral frame portions further including a horizontal linking rod which has two opposite ends extending into said slots of said post units for connection with said post units and which has an inner surface at the same side as said inner surface of the respective one of said frame portions;

a shelf plate disposed transversely between said lateral frame portions and having four corners to be mounted to said post units; and four corner pieces for receiving and mounting said corners of said shelf plate on said lateral frame portions, each of said corner pieces having a bottom wall for resting on said linking rod of a corresponding one of said lateral frame portions, a top wall, and first and second side walls interconnecting said top and bottom walls, said first side wall extending in a direction transverse to said linking rod of the corresponding one of said lateral frame portions, said top and bottom walls and said first and second side walls cooperatively defining a corner space thereamong, each of said corner pieces further having an engaging protrusion which projects from said first side wall in a direction parallel to said linking rod so as to lie longitudinally on said linking rod of the corresponding one of said lateral frame portions while protruding into said slot of an adjacent one of said post units for positioning said corner piece, said second side wall being situated outwardly of the plane of said inner surface of said linking rod of the corresponding one of said lateral frame portions, thus resting said bottom wall on said linking rod.

2. The modular rack according to claim 1, wherein each of said pillars has a circular cross-section, said engaging protrusion and said first side wall of said corner piece forming a rounded corner to embrace the respective one of said pillars.

3. The modular rack according to claim 1, further comprising fasteners for fastening said second side walls of said corner pieces to said shelf plate.

4. The modular rack according to claim 1, wherein said engaging protrusion of said corner piece extends from said second side wall of said corner piece and is coplanar with said second side wall of said corner piece.

5. The modular rack according to claim 4, wherein said engaging protrusion of said corner piece is thicker than said second side wall of said corner piece.

* * * * *